US012709872B2

(12) United States Patent
Kozui et al.

(10) Patent No.: US 12,709,872 B2
(45) Date of Patent: Aug. 18, 2026

(54) CONSTRUCTION MACHINE

(71) Applicants: HIROSHIMA UNIVERSITY, Higashi-Hiroshima (JP); KAWASAKI GAKUEN EDUCATIONAL FOUNDATION, Kurashiki (JP); KOBELCO CONSTRUCTION MACHINERY CO., LTD., Hiroshima (JP)

(72) Inventors: Masatoshi Kozui, Hiroshima (JP); Toru Yamamoto, Hiroshima (JP); Tomohiro Henmi, Okayama (JP); Kazushige Koiwai, Hiroshima (JP)

(73) Assignees: HIROSHIMA UNIVERSITY, Higashi-Hiroshima (JP); KAWASAKI GAKUEN EDUCATIONAL FOUNDATION, Kurashiki (JP); KOBELCO CONSTRUCTION MACHINERY CO., LTD., Hiroshima (JP)

( * ) Notice: Subject to any disclaimer, the term of this patent is extended or adjusted under 35 U.S.C. 154(b) by 659 days.

(21) Appl. No.: 18/006,220

(22) PCT Filed: Jul. 27, 2021

(86) PCT No.: PCT/JP2021/027795
§ 371 (c)(1),
(2) Date: Jan. 20, 2023

(87) PCT Pub. No.: WO2022/025079
PCT Pub. Date: Feb. 3, 2022

(65) Prior Publication Data

US 2023/0257966 A1 Aug. 17, 2023

(30) Foreign Application Priority Data

Jul. 30, 2020 (JP) ..... 2020-129211

(51) Int. Cl.
*E02F 9/26* (2006.01)
*E02F 3/43* (2006.01)

(52) U.S. Cl.
CPC ..... *E02F 9/264* (2013.01); *E02F 3/435* (2013.01)

(58) Field of Classification Search
CPC ..... E02F 9/264; E02F 3/435
See application file for complete search history.

(56) References Cited

U.S. PATENT DOCUMENTS 6,085,583 A * 7/2000 Cannon ..... E02F 3/435 37/413
9,449,437 B2 * 9/2016 Izumi ..... G06Q 40/08
(Continued)

FOREIGN PATENT DOCUMENTS

JP 2009-235833 A 10/2009
JP 2020-20145 A 2/2020
JP 2020-33814 A 3/2020

OTHER PUBLICATIONS

International Search Report issued Sep. 28, 2021 in PCT/JP2021/027795 filed Jul. 27, 2021, 2 pages.
(Continued)

*Primary Examiner* — Hunter B Lonsberry
*Assistant Examiner* — Harrison Heflin
(74) *Attorney, Agent, or Firm* — Oblon, McClelland, Maier & Neustadt, L.L.P.

(57) ABSTRACT

A hydraulic excavator specifies acceleration data being operation data in an acceleration period of a manipulation target and deceleration data being operation data in a deceleration period of the manipulation target among operation data, calculates, on the basis of the acceleration data and acceleration evaluation data, an acceleration evaluation value indicating a skill of an operator in the acceleration period, calculates, on the basis of the deceleration data and
(Continued)

deceleration evaluation data, a deceleration evaluation value indicating a skill of the operator in the deceleration period, determines, on the basis of the acceleration evaluation value and the deceleration evaluation value, a manipulation type of the operator, and outputs support information associated with the manipulation type.

15 Claims, 10 Drawing Sheets

(56) References Cited

U.S. PATENT DOCUMENTS

2007/0239322 A1* 10/2007 McQuade ..... G07C 5/008 701/1
2015/0004572 A1* 1/2015 Bomer ..... G09B 9/042 434/219
2015/0258996 A1* 9/2015 Victor ..... B60W 40/09 340/576
2015/0348178 A1* 12/2015 Taylor ..... G06Q 30/0645 705/307
2016/0026180 A1* 1/2016 Tsimhoni ..... B60W 60/0053 701/23
2016/0288797 A1* 10/2016 Takahashi ..... G07C 5/008
2018/0347149 A1 12/2018 Tomita
2019/0311220 A1* 10/2019 Hazard ..... G06F 18/2148
2020/0031360 A1* 1/2020 Suzuki ..... B60W 50/08
2020/0048866 A1 2/2020 Weber et al.
2020/0324667 A1* 10/2020 Yaldo ..... B60L 58/12
2021/0182753 A1* 6/2021 Shatters ..... G06Q 10/06313
2021/0291856 A1* 9/2021 Uenoyama ..... B60W 60/001
2021/0292999 A1 9/2021 Hamada et al.
2021/0340736 A1 11/2021 Kozui et al.
2023/0078047 A1* 3/2023 Nishi ..... E02F 9/264 701/50

OTHER PUBLICATIONS

Masatoshi Kozui et al. "Construction of the Index to Evaluate the Operating Skill Based on the Motion of CoM for a Hydraulic Excavator", IEEJ Transactions on Electronics, Information and Systems, Apr. 1, 2019, vol. 139. No. 4, pp. 388-394.
Extended European Search Report issued Nov. 17, 2023, in corresponding European Patent Application No. 21848677.7 5 pages.

* cited by examiner

FIG.4

71

| SPECIFIC MANIPULATION | DETERMINATION | $V^s_{in}$ | $\omega_{in}$ | $V^s_{out}$ | $\omega_{out}$ | $T^s_o$ | $\omega_o$ |
|---|---|---|---|---|---|---|---|
| BOOM RAISING AND SUSPENSION | ACCELERATION | 0.6 | 0.5 | 0 | 0 | 0.5 | 0.5 |
| | DECELERATION | 0.1 | 0.3 | 0.2 | 0.3 | 0 | 0 |
| SLEWING POSITION DETERMINATION | ACCELERATION | 0.9 | 0.1 | 0 | 0 | 0.3 | 0.1 |
| | DECELERATION | 0.1 | 0.3 | 0.01 | 0.5 | 0 | 0 |
| ⋮ | ACCELERATION | ⋮ | ⋮ | ⋮ | ⋮ | ⋮ | ⋮ |
| | DECELERATION | ⋮ | ⋮ | ⋮ | ⋮ | ⋮ | ⋮ |

FIG.6

72

| SPECIFIC MANIPULATION | MANIPULATION TYPE | SUPPORT INFORMATION |
|---|---|---|
| BOOM RAISING AND SUSPENDING MANIPULATION | CAUTIOUS | MANIPULATE TO MAKE INTENSITY OF ENGINE SOUND CLEARLY HEARD. |
| | AGGRESSIVE | MANIPULATE TO AVOID SPILLING SOIL FROM BUCKET. |
| SLEWING POSITION DETERMINING MANIPULATION | CAUTIOUS | MANIPULATE TO MAKE SLEWING RELIEF SOUND CLEARLY HEARD. |
| | AGGRESSIVE | MANIPULATE TO SUSPEND SLEWING WHILE CHECKING SUSPENDED POSITION THEREFOR. |
| : | CAUTIOUS | : |
| | AGGRESSIVE | : |

FIG.10

73

| L | FREQUENCY |
|---|---|
| 0—19 | NO DISPLAY |
| 20—39 | AT FINISH TIME OF WORK |
| 40—59 | AT TIME OF KEY "OFF" |
| 60—79 | ONCE/1H |
| 80—99 | TWICE/1H |
| 100 OR MORE | THREE TIMES/1H |

FIG.11

74

| e | ADDITIONAL INFORMATION |
|---|---|
| 0—19 | NO DISPLAY |
| 20—39 | MANIPULATION IS A LITTLE CAUTIOUS. |
| 40—59 | MANIPULATION IS CAUTIOUS. |
| 60 OR MORE | MANIPULATION IS TOO CAUTIOUS. |

CONSTRUCTION MACHINE

TECHNICAL FIELD

The present invention relates to a construction machine, and more specifically, relates to a construction machine for supporting a specific manipulation in association with a manipulation type of an operator.

BACKGROUND ART

A system of evaluating operation data by collecting predetermined operation data of an operator and comparing the collected operation data with reference data (data of a skilled operator) has been conventionally proposed in a field of a construction machine (e.g., Patent Literature 1). The technology described in Patent Literature 1 enables the operator to recognize an operation result about a predetermined manipulation.

Meanwhile, operators to be evaluated for such an operation include some who are cautious and others who are aggressive about a certain manipulation of the construction machine. Therefore, evaluation without considering any manipulation type of an operator to be evaluated for the manipulation may result in giving useless advice to the operator.

In this respect, the technology described in Patent Literature 1 executes exclusive evaluation for all the operators without consideration of the manipulation type of each operator. Hence, there is a possibility that advice given to a certain operator after evaluation of a manipulation executed by the certain operator is unsuitable for the operator, and thus the manipulation is not appropriately supported.

CITATION LIST

Patent Literature

Patent Literature 1: Japanese Unexamined Patent Publication No. 2009-235833

SUMMARY OF INVENTION

Under the circumstances, the present invention has an object of providing a construction machine for appropriately supporting a specific manipulation by an operator in association with a manipulation type of the operator.

To achieve the object, a construction machine according to an aspect of the present invention includes: an operation data acquisition part that acquires operation data about a specific manipulation by an operator: an acceleration and deceleration data specifying part that specifies acceleration data being operation data in an acceleration period and deceleration data being operation data in a deceleration period among the operation data; an evaluation data acquisition part that acquires acceleration evaluation data for evaluating the acceleration data, and deceleration evaluation data for evaluating the deceleration data; an evaluation value calculation part that calculates, on the basis of the acceleration data and the acceleration evaluation data, an acceleration evaluation value indicating a skill of the operator in the acceleration period, and calculates, on the basis of the deceleration data and the deceleration evaluation data, a deceleration evaluation value indicating a skill of the operator in the deceleration period; a manipulation type determination part that determines, on the basis of the acceleration evaluation value and the deceleration evaluation value, a manipulation type of the operator; and a notification part that gives notification of support information associated with the manipulation type determined by the manipulation type determination part.

According to this configuration, the manipulation type of the operator is determined on the basis of the acceleration evaluation value and the deceleration evaluation value, and the support information associated with the manipulation type is notified to the operator. Therefore, a specific manipulation by the operator is appropriately supported in association with the manipulation type of the operator.

BRIEF DESCRIPTION OF DRAWINGS

FIG. 4 shows an evaluation reference table.

FIG. 6 shows a support information table recording support information for each manipulation type.

FIG. 10 shows a frequency table recording a frequency based on the distance.

FIG. 11 shows an additional information table recording additional information based on the distance.

DESCRIPTION OF EMBODIMENTS

1. Embodiment

A construction machine according to an embodiment of the present invention will be described with reference to FIG. 1 to FIG. 7. Hereinafter, a hydraulic excavator 1 (see FIG. 1) serving as an example of a construction machine will be described. The hydraulic excavator 1 has manipulation support operability mounted thereon for supporting a specific manipulation by an operator. As described below, a manipulation of raising a boom and suspending the boom at a predetermined position (hereinafter, simply referred to "boom raising and suspending manipulation" as well) is described as an example of the specific manipulation. The boom is an example of a manipulation target.

Figure 1:
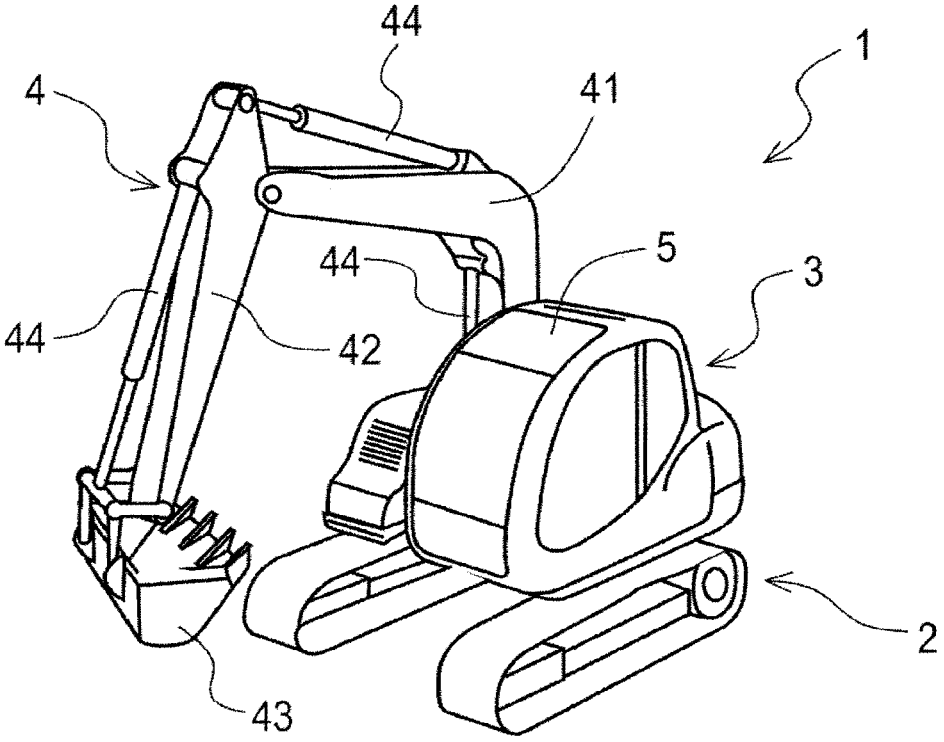
FIG. 1 is a schematic view showing a construction machine (hydraulic excavator) according to an embodiment.

As shown in FIG. 1, the hydraulic excavator 1 includes a lower traveling body 2 and an upper slewing body 3 slewably mounted on the lower traveling body 2.

The upper slewing body 3 is provided with an attachment 4 and a cab 5. The attachment 4 includes a boom 41, an arm 42, a bucket 43, and hydraulic cylinders 44 (actuators) respectively driving these components.

The boom 41 is rotatably supported on a front portion of the upper slewing body 3, the arm 42 is rotatably supported at a distal end of the boom 41, and the bucket 43 is rotatably supported at a distal end of the arm 42. The boom 41, the arm 42, and the bucket 43 are rotated under the control of operations by the corresponding hydraulic cylinders 44.

The cab 5 includes an operator compartment arranged on the front portion of the upper slewing body 3. The hydraulic excavator 1 is operated by an operator having got in the cab 5.

The cab 5 has, in the inside thereof, a seat to allow the operator to sit thereon. An unillustrated manipulation lever is provided on each of the right and the left sides of the seat. Each of the left and right manipulation levers includes a manipulation part for regulating action of each hydraulic cylinder 44 and an unillustrated slewing motor, and is swingingly shifted by the operator forward, backward, leftward, and rightward. The upper slewing body 3 slews and the boom 41 and other components rotate in a direction agreeing with an actuation direction of each of the left and right manipulation levers in accordance with an actuation amount of each of the levers.

The cab 5 further includes, in the inside thereof, input and output devices, such as unillustrated various manipulation switches and a monitor 83 (see FIG. 2), in addition to the left and right manipulation levers. The monitor 83 is an example of a display part in the present invention.

Figure 2:
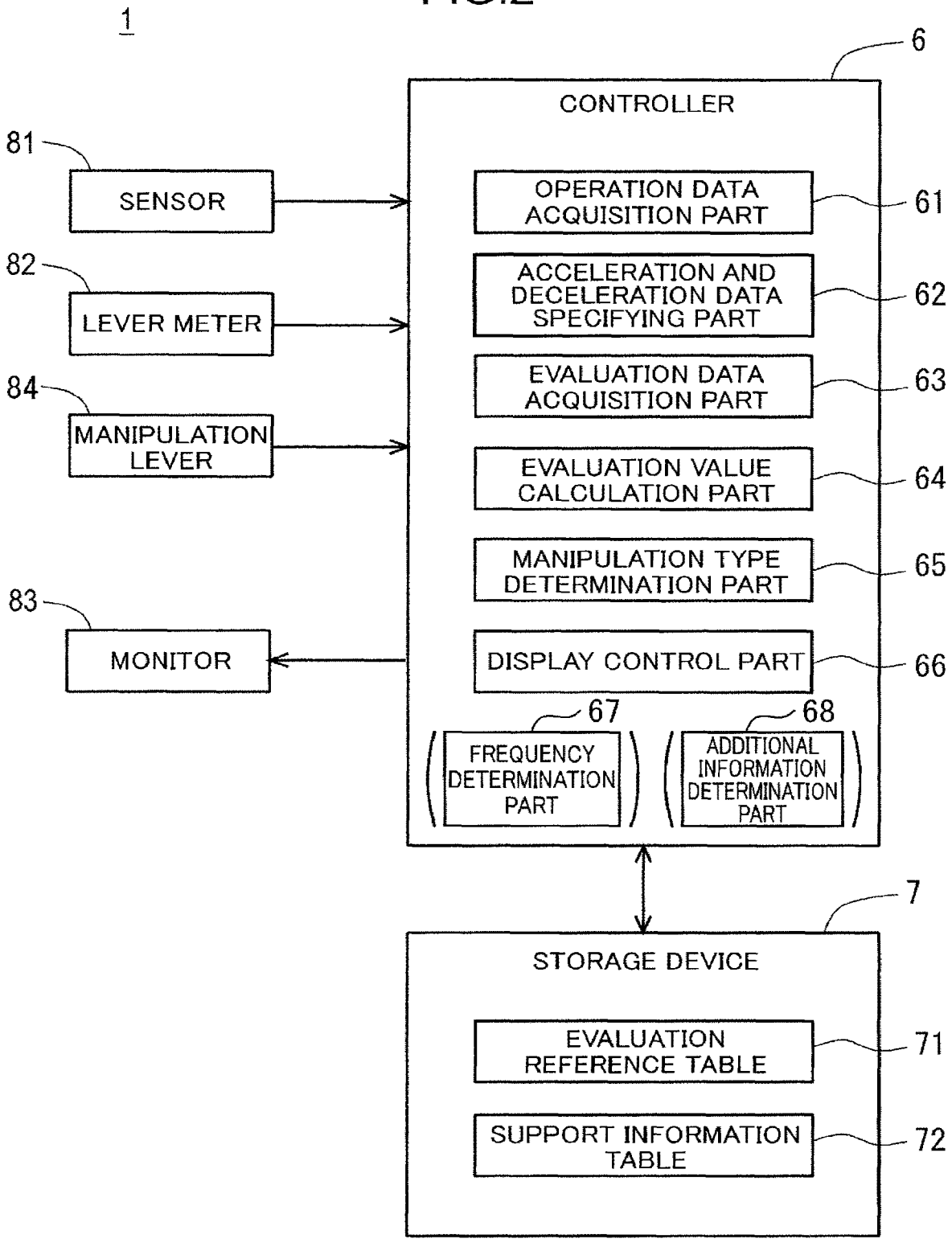
FIG. 2 is a block diagram showing a controller and devices related thereto.

As shown in FIG. 2, the hydraulic excavator 1 includes a controller 6 configured by hardware like a CPU and a memory, and software like a control program mounted on the hardware.

The controller 6 is electrically connected to a storage device 7, a sensor 81, a lever meter 82, the monitor 83, and a manipulation lever 84. The manipulation lever 84 allows the operator to execute manipulation to the manipulation target. Examples of the manipulation target include: a working device including the boom 41, the arm 42, and the bucket 43; the upper slewing body 3; and the lower traveling body 2.

The sensor 81 is attached to each hydraulic cylinder 44 to detect a speed of extension and contraction of the hydraulic cylinder 44 as an actual speed $S_a(t)$. The actual speed $S_a(t)$ is detected by the sensor 81 at a predetermined interval (sampling interval) and input to the controller 6.

The lever meter 82 is attached to the manipulation lever 84. The lever meter 82 detects an actuation amount U(t) of the manipulation lever 84. The actuation amount U(t) is detected by the lever meter 82 at a predetermined interval (sampling interval) and input to the controller 6. When the manipulation lever 84 is formed of a hydraulic manipulation lever, the lever meter 82 includes a pressure sensor for detecting a pilot pressure. When the manipulation lever 84 is formed of an electric manipulation lever, the lever meter 82 includes a potentiometer.

The controller 6 operatively includes an operation data acquisition part 61, an acceleration and deceleration data specifying part 62, an evaluation data acquisition part 63, an evaluation value calculation part 64, a manipulation type determination part 65, and a display control part 66. Each of the operation data acquisition part 61 to the display control part 66 may include a dedicated electronic circuit, such as an ASIC.

The operation data acquisition part 61 acquires operation data (which will be described later) about a specific manipulation executed by an operator to be evaluated.

The acceleration and deceleration data specifying part 62 specifies acceleration data being operation data in an acceleration period of the manipulation target and deceleration data being operation data in a deceleration period of the manipulation target among the operation data.

The evaluation data acquisition part 63 acquires acceleration evaluation data for evaluating the acceleration data and deceleration evaluation data for evaluating the deceleration data with reference to an evaluation reference table 71 (see FIG. 4).

The evaluation value calculation part 64 calculates, on the basis of the acceleration data and the acceleration evaluation data, an acceleration evaluation value Ea, and calculates, on the basis of the deceleration data and the deceleration evaluation data, a deceleration evaluation value Ed. For instance, the evaluation value calculation part 64 decreases the acceleration evaluation value Ea in accordance with an increase in a difference between the acceleration data and the acceleration evaluation data, and decreases the deceleration evaluation value Ed in accordance with an increase in a difference between the deceleration data and the deceleration evaluation data. A specific way of calculating the acceleration evaluation value Ea and the deceleration evaluation value Ed will be described in detail later. The acceleration evaluation value Ea is a numeric value representing a skill of the operator in the acceleration period. In the embodiment, a larger acceleration evaluation value Ea shows a higher skill of the operator. The deceleration evaluation value Ed is a numeric value representing a skill of the operator in the deceleration period. In the embodiment, a larger deceleration evaluation value Ed shows a higher skill of the operator.

The manipulation type determination part 65 determines, on the basis of the acceleration evaluation value Ea and the deceleration evaluation value Ed, a manipulation type of the operator having executed the specific manipulation. Here, the manipulation type determination part 65 determines the manipulation type of the operator as either an "aggressive" type or a "cautious" type. A specific way of determining the manipulation type will be described in detail later. The manipulation type represents characteristics of manipulation of the operator.

The display control part 66 generates a manipulation support image including support information associated with the manipulation type and outputs the generated manipulation support image to the monitor 83. The display control part 66 is an example of a "notification part" in the present invention.

Figure 3:
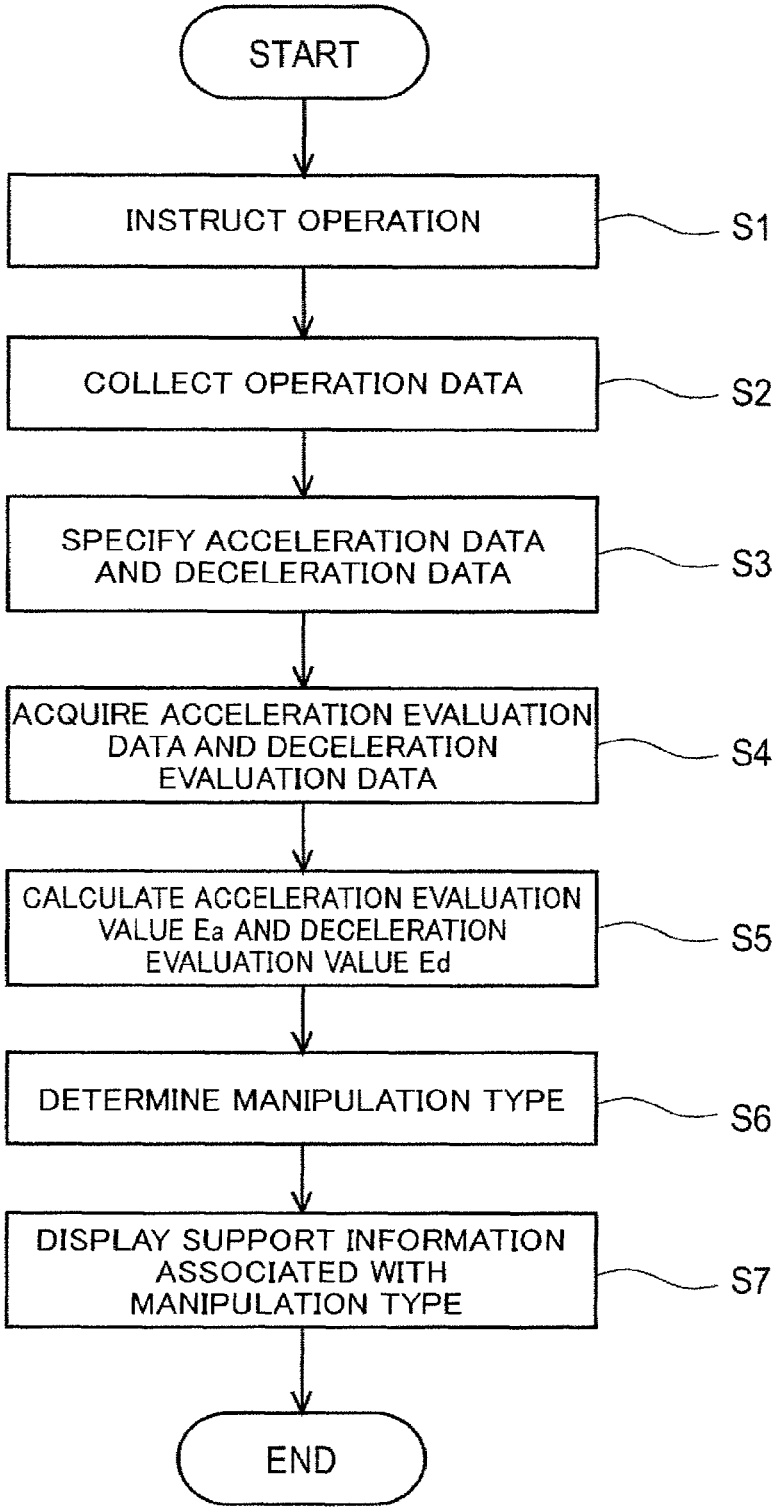
FIG. 3 is a flowchart showing a manipulation support process of supporting a specific manipulation.

Next, a manipulation support process of supporting a specific manipulation (here, the boom raising and suspending manipulation) by the operator will be described with reference to the flowchart in FIG. 3.

First, in step S1, the display control part 66 outputs an unillustrated display image showing an instruction for a start of the boom raising and suspending manipulation to the monitor 83 to instruct the operator to execute a relevant work.

In step S2, the operation data acquisition part 61 acquires operation data about the boom raising and suspending manipulation executed by the operator in accordance with the instruction for the work. Specifically, the operation data acquisition part 61 acquires the operation data including an actuation amount U(t) detected at a predetermined interval, a suspended position $V_{out}$ of a specific portion of the boom 41, and a raising time $T_o$ thereof.

Here, the actuation amount U(t) represents a value detected via the lever meter 82 at the predetermined interval (sampling interval) in the period of the boom raising and suspending manipulation.

Moreover, the suspended position $V_{out}$ of the specific portion of the boom 41 represents, for example, a coordinate of a position, i.e., a height position, where the distal end of the boom 41 is suspended. The height position where the distal end of the boom 41 is suspended is calculatable from a value of an angle sensor provided to the boom 41.

Furthermore, the raising time $T_o$ represents a time in a period of acceleration from the start of manipulation to the boom 41 in the boom raising and suspending manipulation. The raising time $T_o$ is an example of an acceleration period value indicating a length of the acceleration period.

In step S3, the acceleration and deceleration data specifying part 62 specifies the acceleration data being operation data in the acceleration period and deceleration data being operation data in the deceleration period among the operation data acquired in step S2.

Specifically, the acceleration and deceleration data specifying part 62 specifies the data as the acceleration data when an acceleration rate $\alpha(t)$ calculated on the basis of the actual speed $S_a(t)$ detected by the sensor 81 is equal to or higher than 0 (acceleration rate $\alpha \geq 0$), and specifies the data as the deceleration data when the acceleration rate is lower than 0 (acceleration rate $\alpha < 0$). For instance, the acceleration rate $\alpha(t)$ is calculated on the basis of Equation 1 described below. In Equation 1, the sign "$S_a(t)$" denotes a speed at a present time "t", the sign "$S_a(t-1)$" denotes a speed at a time that is one stage before the time "t", and the sign "$\Delta t$" denotes an elapsed time from $S_a(t-1)$ to $S_a(t)$. Moreover, although the calculation is performed at a difference of the one stage in the embodiment, the calculation may be performed in comparison with data in a further previous stage.

$$\alpha(t) = \frac{-S_a(t) - S_a(t-1)}{\Delta t} \quad \text{Equation 1}$$

In step S4, the evaluation data acquisition part 63 acquires acceleration evaluation data and deceleration evaluation data about the boom raising and suspending manipulation with reference to the evaluation reference table 71 (see FIG. 4) stored in the storage device 7.

As shown in FIG. 4, the evaluation reference table 71 has recordation of acceleration evaluation data being operation data in an acceleration period and deceleration evaluation data being operation data in a deceleration period about a specific manipulation executed by a skilled operator in advance. The skilled operator has a plenty of operational experiences of the hydraulic excavator 1, for example, has a predetermined year (e.g., 10 year) or longer operational experiences.

In the evaluation reference table 71, the sign "$V^s_{in}$" denotes an average or a variance of actuation amounts U(t) detected via the lever meter 82 at predetermined intervals in the acceleration period or the deceleration period. The sign "$V^s_{in}$" is an example of an actuation amount of a manipulation part by the skilled operator in the acceleration period or the deceleration period. The sign "$V^s_{out}$" denotes a position, i.e., height position, where a specific portion (distal end) of the boom 41 is suspended in the deceleration period. The sign "$V^s_{out}$" is an example of the suspended position of the manipulation target that is attained by the skilled operator in the deceleration period. The sign "$T^s_o$" denotes a raising time of the boom 41 in the acceleration period. The sign "$T^s_o$" is an example of an acceleration period value indicating a length of the acceleration period of the skilled operator.

Moreover, each of the signs "$\omega_{in}$", "$\omega_{out}$", and "$\omega_o$" in the evaluation reference table 71 denotes a weighting parameter for use in calculating each of the acceleration evaluation value Ea and the deceleration evaluation value Ed to be described later.

In step S5, the evaluation value calculation part 64 calculates, on the basis of Equation 2 described below, the acceleration evaluation value Ea and the deceleration evaluation value Ed.

$$E = 100 - \left(\omega_{in}\frac{|V^s_{in} - V_{in}|}{V^s_{in}} + \omega_{out}\frac{|V^s_{out} - V_{out}|}{V^s_{out}} + \omega_o\frac{|T^s_o - T_o|}{T^s_o}\right) \times 100 \quad \text{Equation 2}$$

First, in the calculation of the acceleration evaluation value Ea, the evaluation value calculation part 64 obtains an average $V_{in}$ or a variance $V_{in}$ of the actuation amounts U(t) specified as the acceleration data in step S3. The average $V_{in}$ or the variance $V_{in}$ of the actuation amounts U(t) in the acceleration period is an example of an acceleration actuation amount indicating an amount of actuation of the manipulation part by the operator in the acceleration period. The average $V_{in}$ or the variance $V_{in}$ of the actuation amounts U(t) in the deceleration period is an example of a deceleration actuation amount indicating an amount of actuation of the manipulation part by the operator in the deceleration period.

The evaluation value calculation part 64 substitutes: "$V_{in}$"; "$V_{out}$" and "$T_o$" obtained in step S2; and "$V^s_{in}$", "$V^s_{out}$", "$T^s_o$", "$\omega_{in}$", "$\omega_{out}$" and "$\omega_o$" of the acceleration evaluation data acquired in step S4 for Equation 2 to calculate the acceleration evaluation value Ea.

Here, "0" is input in "$\omega_{out}$" of the acceleration evaluation data, and therefore, parameters about the suspended position are ignored in the calculation of the acceleration evaluation value Ea. Specifically, the evaluation value calculation part 64 decreases the acceleration evaluation value Ea in accordance with an increase in a difference ($|V^s_{in} - V_{in}|$) between the acceleration actuation amount by the operator and the acceleration actuation amount by the skilled operator, and an increase in a difference ($|T^s_o - T_o|$) between the acceleration period value of the operator and the acceleration period value of the skilled operator.

Moreover, in the calculation of the deceleration evaluation value Ed, the evaluation value calculation part 64 obtains an average $V_{in}$ or a variance $V_{in}$ of the actuation amounts U(t) specified as the deceleration data in step S3.

The evaluation value calculation part 64 substitutes: "$V_{in}$", "$V_{out}$" and "$T_o$" obtained in step S2; and "$V^s_{in}$", "$V^s_{out}$", "$T^s_o$", "$\omega_{in}$", "$\omega_{out}$" and "$\omega_o$" of the deceleration evaluation data acquired in step S4 for Equation 2 to calculate the deceleration evaluation value Ed.

Here, "0" is input in "$\omega_o$" of the deceleration evaluation data, and therefore, parameters about the raising time are ignored in the calculation of the deceleration evaluation value Ed. Specifically, the evaluation value calculation part 64 decreases the deceleration evaluation value Ed in accordance with an increase in a difference ($|V^s_{in} - V_{in}|$) between the deceleration actuation amount by the operator and the deceleration actuation amount by the skilled operator, and an increase in a difference ($|V^s_{out} - V_{out}|$) between the suspended position attained by the operator and the suspended position attained by the skilled operator.

As described heretofore, in the embodiment, both the acceleration evaluation value Ea and the deceleration evaluation value Ed are calculated with the common Equation 2 by adjusting the weighting parameters "$\omega_{in}$", "$\omega_{out}$", and "$\omega_o$".

In step S6, the manipulation type determination part 65 determines, on the basis of the acceleration evaluation value Ea and the deceleration evaluation value Ed calculated in step S5, a manipulation type of the operator having executed the boom raising and suspending manipulation.

Figure 5:
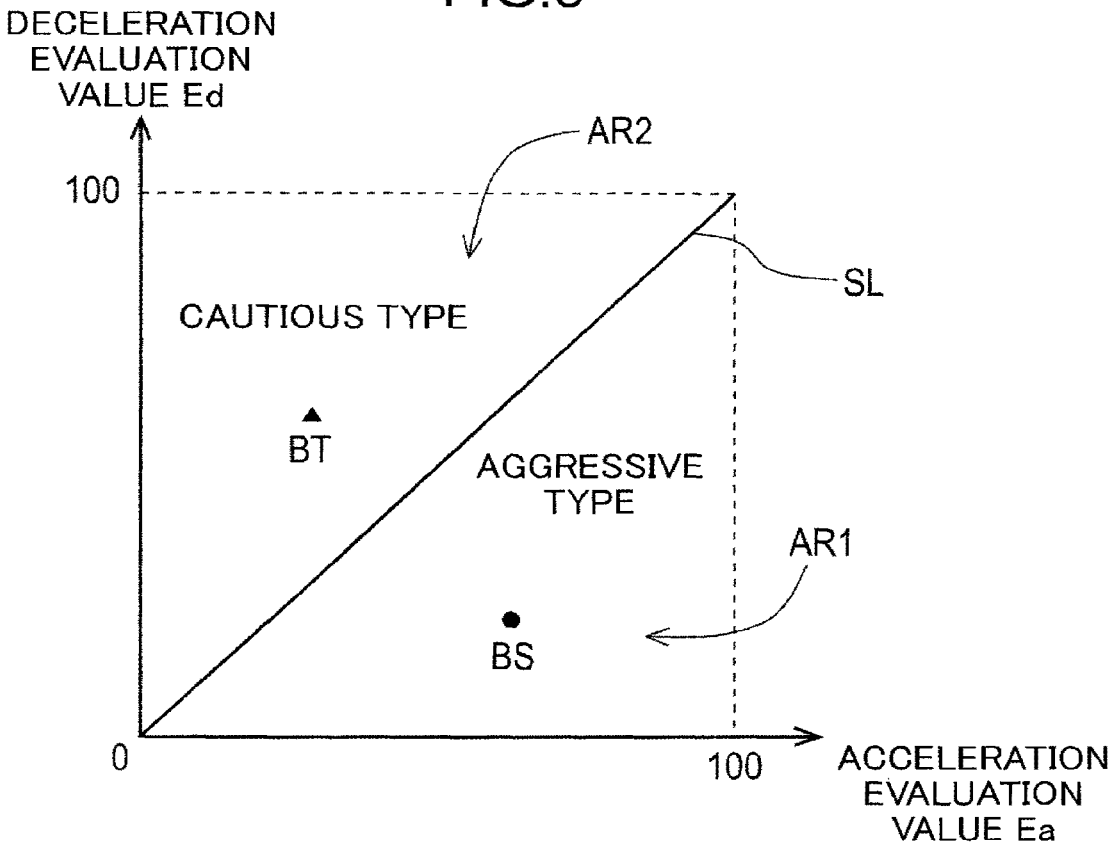
FIG. 5 shows a two-dimensional graph having a horizontal axis denoting an acceleration evaluation value and a vertical axis denoting a deceleration evaluation value.

FIG. 5 shows a two-dimensional graph having a horizontal axis denoting the acceleration evaluation value Ea and a vertical axis denoting the deceleration evaluation value Ed. A straight line SL shown in the two-dimensional graph is a line (having a slope of 1 and a y-intercept of 0) obtained by connecting an origin (where the acceleration evaluation value Ea=0, and the deceleration evaluation value Ed=0) and a maximum point (where the acceleration evaluation value Ea=100 and the deceleration evaluation value Ed=100) to each other.

The manipulation type determination part 65 determines the manipulation type of the operator as the "aggressive" type when the acceleration evaluation value Ea and the deceleration evaluation value Ed are plotted in an area AR1 (e.g., the black circular point BS in FIG. 5) to the lower right of the straight line SL in the two-dimensional graph in FIG. 5. Specifically, in the embodiment, the manipulation type determination part 65 determines the manipulation type of the operator as the "aggressive" type when the acceleration evaluation value Ea is larger than the deceleration evaluation value Ed (Ea>Ed).

Contrarily, the manipulation type determination part 65 determines the manipulation type of the operator as the "cautious" type when the acceleration evaluation value Ea and the deceleration evaluation value Ed are plotted on the straight line SL or in an area AR2 to the upper left of the straight line SL (e.g., the black triangular point BT in FIG. 5) in the two-dimensional graph in FIG. 5. Specifically, in the embodiment, the manipulation type determination part 65 determines the manipulation type of the operator as the "cautious" type when the acceleration evaluation value Ea is equal to or smaller than the deceleration evaluation value Ed (Ea≤Ed).

In step S7, the display control part 66 generates a manipulation support image including support information associated with the manipulation type and outputs the generated manipulation support image to the monitor 83.

Specifically, the display control part 66 acquires the support information associated with the manipulation type determined in step S6 with reference to a support information table 72 shown in FIG. 6. For instance, when the manipulation type is determined as the "cautious" type in step S6, the display control part 66 acquires support information (in the bold framed box) associated with the "cautious" type of the "boom raising and suspending".

The support information recorded in the support information table 72 represents information (message) for presenting a state (intensity of the engine sound, soil in the bucket or the like) of the hydraulic excavator 1 to be focused on by the operator. In other words, the support information is information (message) for indirectly improving a skill for the boom raising and suspending manipulation by showing the state of the hydraulic excavator 1 to be focused on by the operator.

Specifically, the support information table 72 stores a manipulation type and support information associated with the manipulation type for each specific manipulation. Examples of the specific manipulation include the boom raising and suspending manipulation and a slewing position determining manipulation. The manipulation type includes the above-described "cautious" type and "aggressive type". For instance, when the specific manipulation indicates the "boom raising and suspending manipulation" and the manipulation type indicates the "cautious" type, adoptable support information shows a message, "Manipulate to make intensity of engine sound clearly heard.", to encourage a more aggressive manipulation. For example, when the specific manipulation indicates the "boom raising and suspending manipulation" and the manipulation type indicates the "aggressive type", adoptable support information shows a message, "Manipulate to avoid spilling soil from bucket.", to encourage a more cautious manipulation. As described heretofore, the support information includes information for presenting a state (e.g., "intensity of the engine sound") of the hydraulic excavator 1 to be focused on by the operator and information (e.g., "Manipulate to make intensity of engine sound clearly heard.") to directly improve a skill for a specific manipulation. Accordingly, the operator can grasp a way of operating the hydraulic excavator 1 to be in a certain state for improvement in the specific manipulation.

Figure 7:
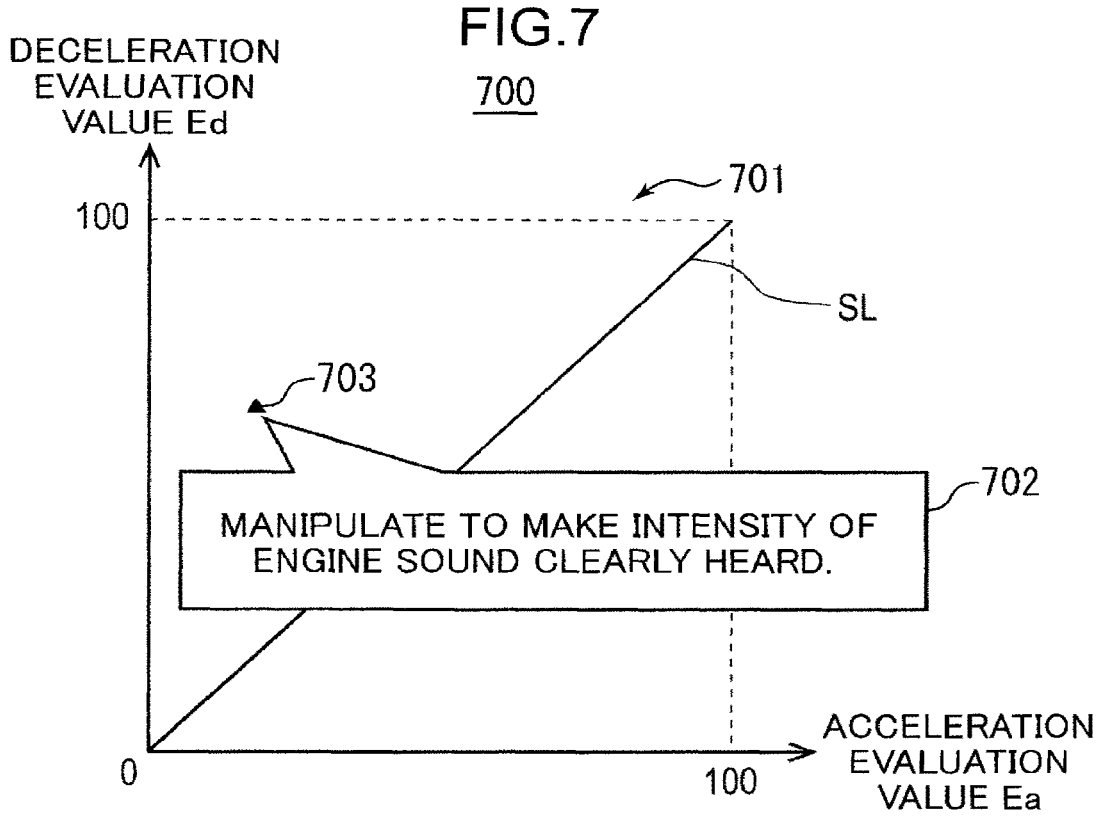
FIG. 7 shows an example of a manipulation support image output to a monitor.

Moreover, as shown in FIG. 7, the display control part 66 generates a manipulation support image 700 including support information (speech bubble image portion in FIG. 7) superimposed on the two-dimensional graph 701, in which the acceleration evaluation value Ea and the deceleration evaluation value Ed are plotted, to be displayed, and outputs the generated manipulation support image to the monitor 83.

FIG. 7 shows an example of the manipulation support image 700 about the specific manipulation indicating the "boom raising and suspending manipulation" and the manipulation type indicating the "cautious" type. The manipulation support image 700 includes the speech bubble image 702 showing support information, and an image having a two-dimensional graph 701 in which a point 703 indicating the acceleration evaluation value Ea and the deceleration evaluation value Ed of the operator is plotted. In the two-dimensional graph 701, a straight line SL distinguishing the "cautious" type and the "aggressive" type concerning the manipulation type from each other is plotted. The speech bubble image 702 is displayed in association with the point 703. The speech bubble image 702 shows support information (here, "Manipulate to make intensity of engine sound clearly heard.") registered in the support information table 72 in advance for the specific manipulation (boom raising and suspending manipulation) and the manipulation type that is the "cautious" type. The operator having browsed the manipulation support image 700 can grasp a manipulation tendency thereof and a matter to be improved in the manipulation.

According to the embodiment, the manipulation type of the operator is determined on the basis of the acceleration evaluation value Ea and the deceleration evaluation value Ed, and the support information associated with the determined manipulation type is notified to the operator. This results in achieving support (manipulation support) suitable for the manipulation type ("aggressive" type or "cautious" type) of the operator executing a specific manipulation (boom raising and suspending manipulation) in the hydraulic excavator 1.

Moreover, according to the embodiment, the state (intensity of the engine sound or soil in the bucket) of the hydraulic excavator 1 as support information to be focused on by the operator is presented. Hence, effective manipulation support is available to an unskilled operator facing difficulty in following a direct instruction.

2. Modifications

The construction machine according to the present invention is not limited to the above-described embodiment, and various modifications and improvements are applicable within the scope of the claims.

For instance, although the boom raising and suspending manipulation is described as an example of the specific manipulation in the embodiment, the specific manipulation is not limited thereto. The concept of the present invention is adoptable for any manipulation accompanied by acceleration and deceleration. Specifically, a manipulation type of an operator for a slewing position determining manipulation of executing slewing and suspension in a predetermined direction is determined, and support information associated with the manipulation type is presentable to the operator.

In the above-described embodiment, described as an example is the case where each of the acceleration data and the deceleration data is specified at an acceleration rate $\alpha(t)$ calculated on the basis of the actual speed $S_a(t)$, but the specifying way is not limited thereto. Each of the acceleration data and the deceleration data may be specified by using only shift data (shift average or the like) of the actuation amount U(t). Alternatively, each of the acceleration data and the deceleration data may be specified in accordance with a combination of the acceleration rate $\alpha(t)$ and the actuation amount U(t).

Besides, in the embodiment, as shown in FIG. 7, the manipulation support image 700 including the support information (speech bubble image 702 in FIG. 7) superimposed on the two-dimensional graph 701 in which the acceleration evaluation value Ea and the deceleration evaluation value Ed are plotted is displayed on the monitor 83, but the present invention is not limited thereto. For instance, the manipulation support image 700 showing only a text (message in the speech bubble image 702) of the support information may be output to the monitor 83 without displaying of the two-dimensional graph 701.

Further, in the embodiment, the manipulation support image 700 (FIG. 7) in which only a single acceleration evaluation value Ea and a single deceleration evaluation value Ed are plotted on the premise that the boom raising and suspending manipulation is executed once, but the manipulation support image is not limited thereto.

Figure 8:
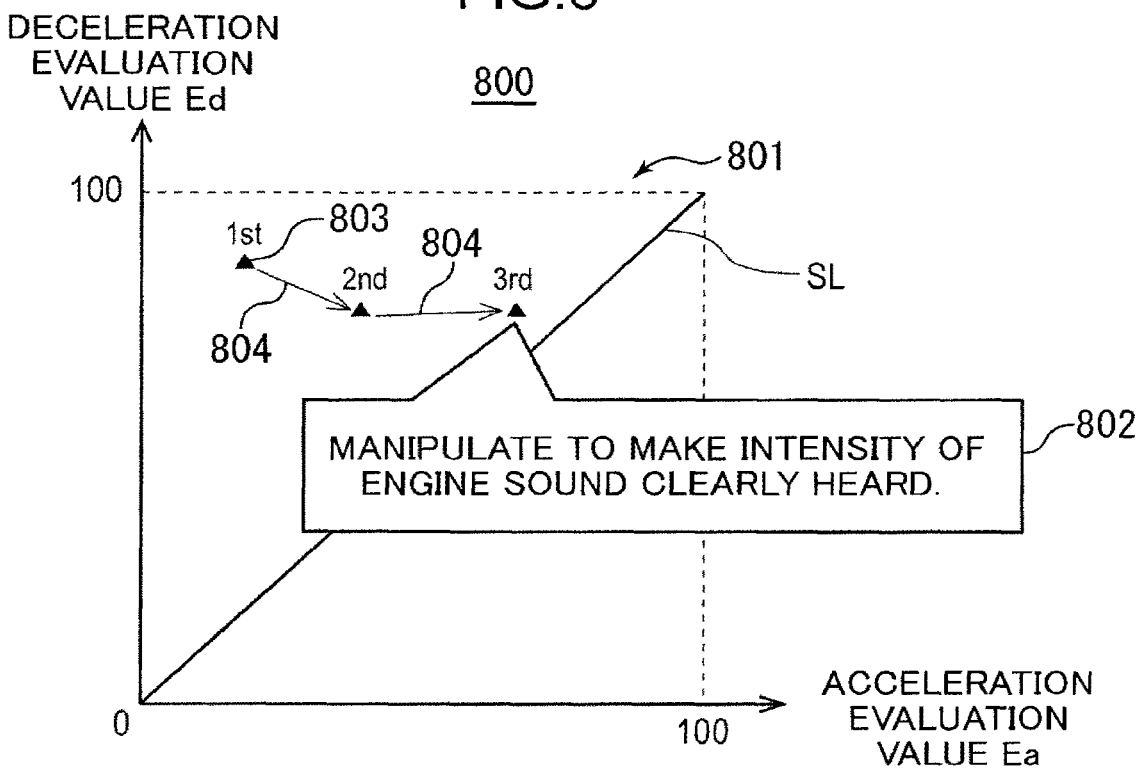
FIG. 8 shows an example of a manipulation support image in a modification.

For instance, when the boom raising and suspending manipulation is repeated, a manipulation support image 800 (FIG. 8) in which a plurality of acceleration evaluation values Ea and a plurality of deceleration evaluation values Ed are plotted may be generated. As shown in FIG. 8, the manipulation support image 800 includes an image having a two-dimensional graph 801 in which a plurality of points 803 each indicating the acceleration evaluation value Ea and the deceleration evaluation value Ed, and an indicator 804 showing a time shift of each point 803 are further plotted. The indicator 804 connects the points 803 in a time series. The two-dimensional graph 801 has the same vertical axis and horizontal axis as those of the two-dimensional graph 701. Moreover, the manipulation support image 800 includes a speech bubble image 802. Details of the speech bubble image 802 are the same as those of the speech bubble image 702.

Specifically, the evaluation value calculation part 64 may store, in a time series, the acceleration evaluation value Ea and the deceleration evaluation value Ed in the storage device 7 at each execution of the boom raising and suspending manipulation. The display control part 66 may generate the manipulation support image 800 including an image having the two-dimensional graph 801 in which the points 803 and the indicator 804 are plotted.

Further, although the manipulation support image 700 (FIG. 7) including the support information is output to the monitor 83 at the time of completion of the boom raising and suspending manipulation, the output way is not limited thereto.

Figure 9:
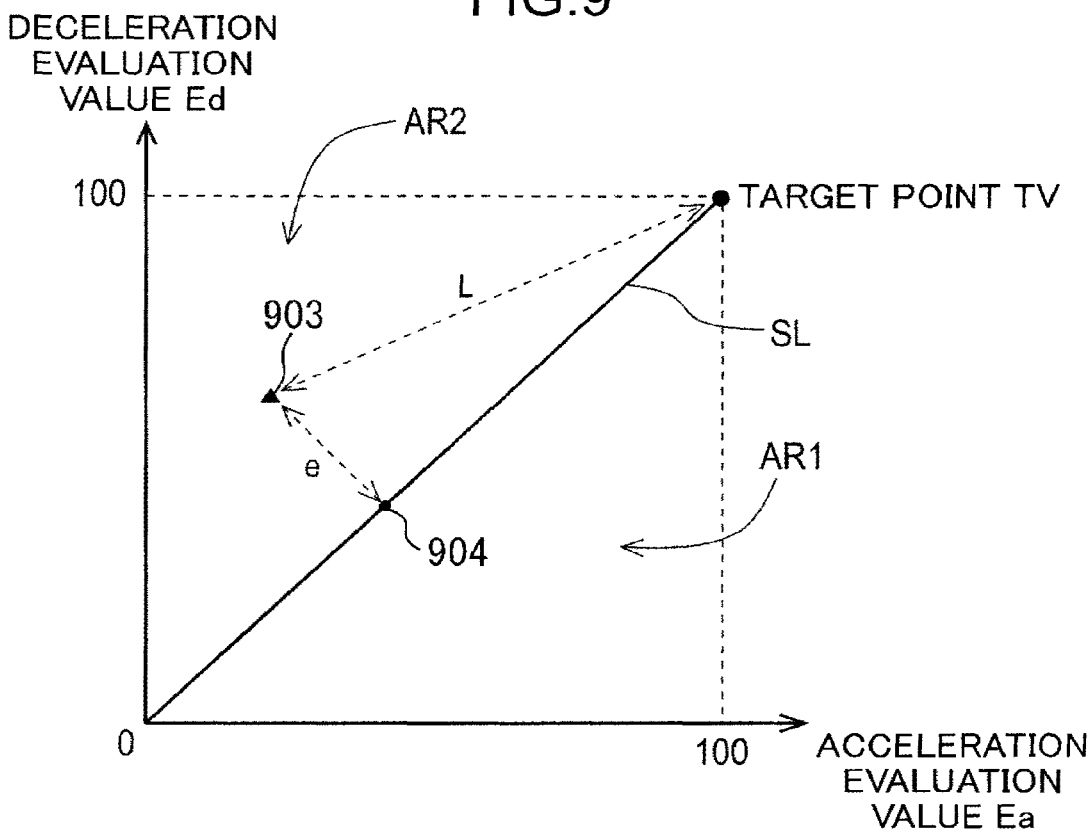
FIG. 9 is a view explaining a distance between the acceleration evaluation value and the deceleration evaluation value, and a target value.

For instance, in repetitions of the boom raising and suspending manipulation, the controller 6 may determine a frequency of outputting the manipulation support image 700 on the basis of a distance L (see FIG. 9) between a point 903 (which is an example of evaluation data) indicating a previous acceleration evaluation value Ea and a previous deceleration evaluation value Ed, and a target point TV (which is an example of target data), and output the manipulation support image 700 to the monitor 83 at the determined frequency. The target point TV is defined by an acceleration target value predetermined for the acceleration evaluation value and a deceleration target value predetermined for the deceleration evaluation value. An example of each of the acceleration target value and the deceleration target value indicates "100".

In this case, the controller 6 may further include a frequency determination part 67 to determine the frequency of outputting the manipulation support image 700. The frequency determination part 67 calculates the distance L on the basis of Equation 3 described below.

$$L=\sqrt{(100-E_a)^2+(100-E_d)^2} \quad \text{Equation 3}$$

Moreover, the frequency determination part 67 determines a frequency associated with a value of the calculated distance L as an output frequency of the manipulation support image 700 with reference to a frequency table 73 in FIG. 10. In Equation 3, the numeral "100" in the first parentheses indicates the acceleration target value and the numeral "100" in the second parentheses indicates the deceleration target value. The frequency table 73 defines a relation between the distance L and the frequency so that the frequency increases in accordance with an increase in the distance L. For instance, the frequency table 73 defines the relation between the distance and the frequency so that: the manipulation support image 700 is not displayed when a value of the distance L is equal to or larger than 0 and equal to or smaller than 19; the manipulation support image 700 is displayed at a finish of a work when the value of the distance L is equal to or larger than 20 and equal to or smaller than 39; and the manipulation support image 700 is displayed when a key of the hydraulic excavator 1 is turned off and the value of the distance L is equal to or larger than 40 and equal to or smaller than 59.

For example, the frequency determination part 67 determines the frequency to "once/one hour, i.e., 1 h" with reference to the frequency table 73 when the value of the distance L is "62". In this case, the display control part 66 may output the manipulation support image 700 to the monitor 83 at the frequency of once an hour. The frequency determination part 67 may determine the frequency to "twice/1 h" when the value of the distance L is "86". In this case, the display control part 66 may output the manipulation support image 700 at the frequency of twice an hour.

According to the modification, when the distance between the point 903 indicating the acceleration evaluation value Ea and the deceleration evaluation value Ed, and the target point TV is longer (in other words, the skill of the operator is lower), the manipulation support image 700 is output at a high frequency. This makes it possible to encourage the operator to improve the skill thereof. Contrarily, when the distance between the point 903 indicating the acceleration evaluation value Ea and the deceleration evaluation value Ed, and the target point TV is shorter (in other words, the skill of the operator is higher), the manipulation support image 700 is output at a low frequency (or no manipulation support image is output). This makes it possible to prevent unnecessary information from being presented to the operator. Consequently, support appropriate for the skill is achievable.

Although each of the manipulation support images 700, 800 including the support information associated with a manipulation type in advance is generated in the embodiment, the manipulation support image is not limited thereto. For instance, additional information to be added to the support information may be determined on the basis of a distance between evaluation data including an acceleration evaluation value Ea and the deceleration evaluation value Ed, and a target data set in advance, and a manipulation support image including the support information and the additional information may be generated.

Here, described is an example of an aspect of determining the additional information on the basis of a distance "e" (see FIG. 9) of a perpendicular line extending downward from the point 903 (which is an example of the evaluation data) indicating the acceleration evaluation value Ea and the deceleration evaluation value Ed perpendicularly to the straight line SL. In this aspect, data including an acceleration evaluation value Ea and a deceleration evaluation value Ed at an intersection 904 between the perpendicular line and the straight line SL is an example of target data.

In this aspect, the controller 6 may further include an additional information determination part 68 that determines additional information to be added to the support information. The additional information determination part 68 may calculate the distance "e" on the basis of the following Equation 4.

$$e = \frac{|-E_a + E_d|}{\sqrt{2}} \qquad \text{Equation 4}$$

The additional information determination part 68 determines additional information associated with a value of the calculated distance "e" with reference to an additional information table 74 shown in FIG. 11. The additional information table 74 represents an additional information table 74 for a specific manipulation that is the "boom raising and suspending manipulation" and a manipulation type that is the "cautious" type. The additional information table 74 defines the additional information based on the distance "e" so that cautiousness about manipulation is further emphasized in accordance with an increase in the distance "e". For instance, when a value of the distance "e" is equal to or larger than 0 and equal to or smaller than 19, no additional information is displayed. The additional information shows, "The manipulation is a little cautious.", when the value of the distance "e" is equal to or larger than 20 and equal to or smaller than 39. The additional information shows, "The manipulation is cautious.", when the value of the distance "e" is equal to or larger than 40 and equal to or smaller than 59.

Figure 12:
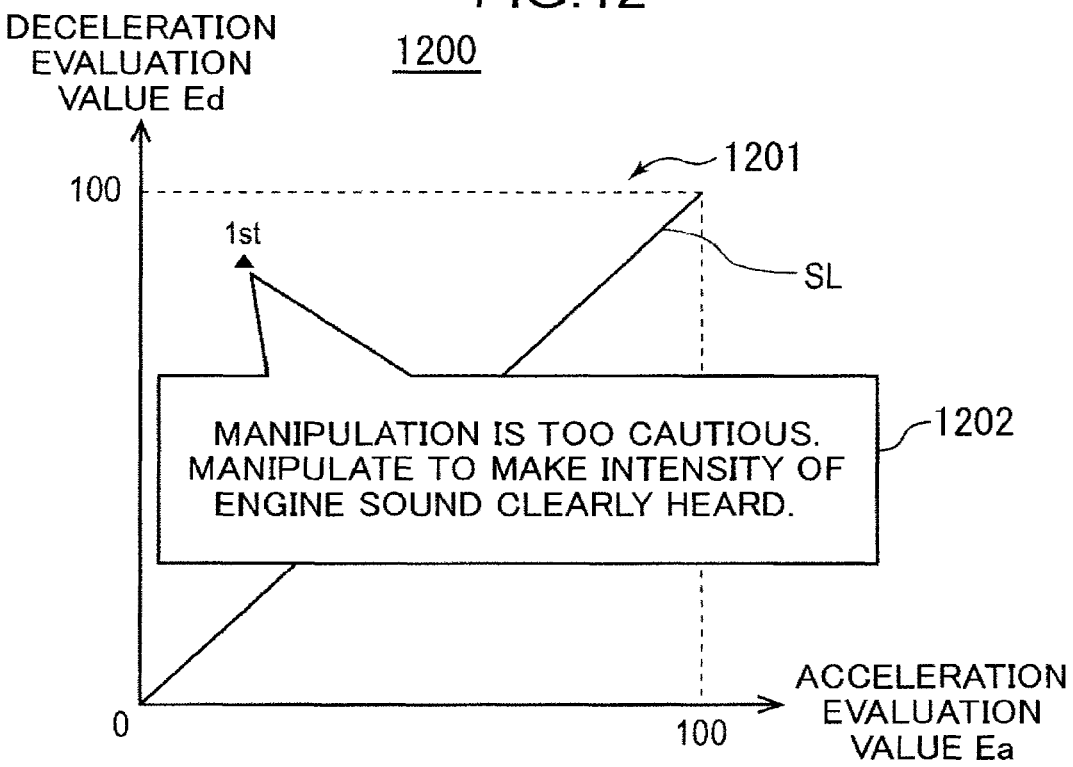
FIG. 12 shows an example of a manipulation support image in another modification.

For instance, the additional information determination part 68 determines the additional information showing, "Manipulation is too cautious.", when the value of the distance "e" is "74". In this case, the display control part 66 may output a manipulation support image 1200 shown in FIG. 12 to the monitor 83. The manipulation support image 1200 shown in FIG. 12 includes a two-dimensional graph 1201 and a speech bubble image 1202. The speech bubble image 1202 includes a message set containing the message, "Manipulation is too cautious.", indicated by the additional information in addition to and prior to the message of the support information (in the bold framed box in FIG. 6) about the "cautious" type. The contents of the two-dimensional graph 1201 are the same as those of the two-dimensional graph 701.

Figure 13:
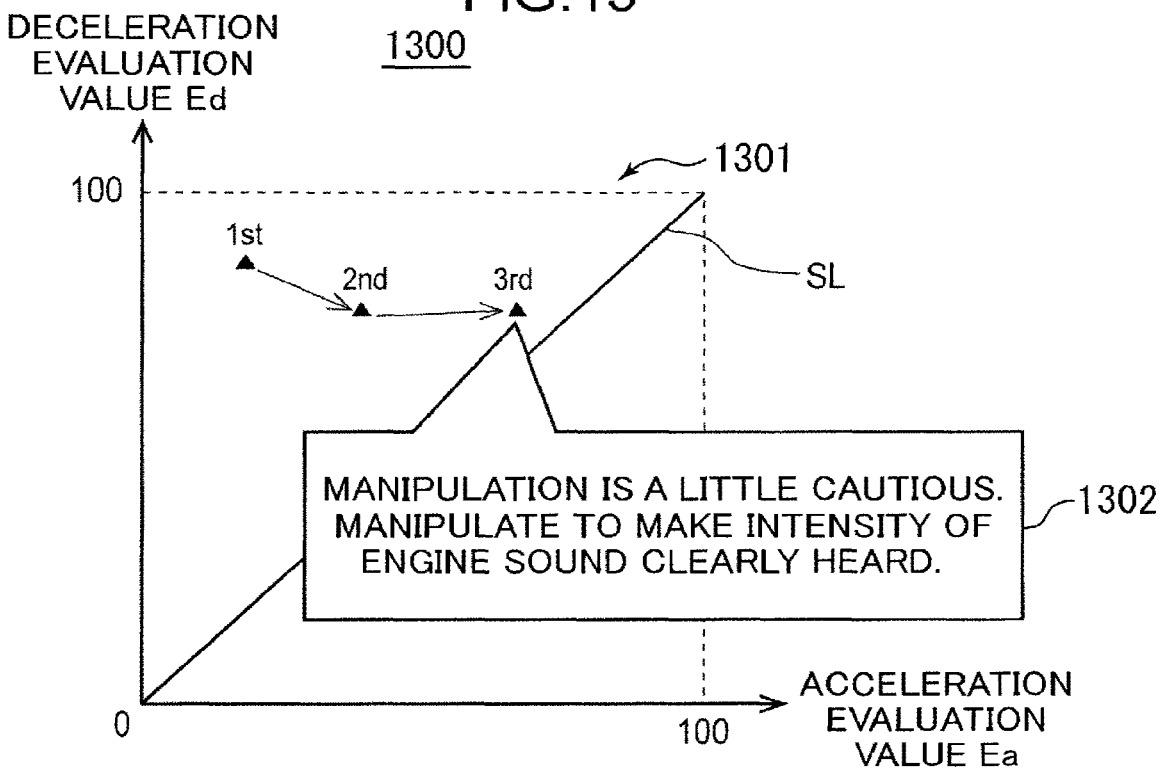
FIG. 13 shows an example of a manipulation support image in further another modification.

For instance, the additional information determination part 68 determines the additional information showing, "Manipulation is a little cautious.", with reference to the additional information table 74 when the value of the distance "e" is "22". In this case, the display control part 66 may output a manipulation support image 1300 shown in FIG. 13 to the monitor 83. The manipulation support image 1300 shown in FIG. 13 includes a two-dimensional graph 1301 and a speech bubble image 1302. The speech bubble image 1302 includes a message set containing the message, "Manipulation is a little cautious.", indicated by the additional information determined by the additional information determination part 68 in addition to and prior to the message of the support information (in the bold framed box in FIG. 6) about the "cautious" type. The two-dimensional graph 1301 is the same as the two-dimensional graph 801. The speech bubble image 1302 is displayed in association with a latest point indicating an acceleration evaluation value Ea and a deceleration evaluation value Ed.

According to the modification, contents to be displayed on a manipulation support image is changeable on the basis of a distance (in other words, the skill of the operator) between an acceleration evaluation value Ea and a deceleration evaluation value Ed, and a target value. For instance, an emphatic message is added to support information and displayed for an operator having a low skill and showing a long distance between the acceleration evaluation value Ea and the deceleration evaluation value Ed, and the target data. Alternatively, an unemphatic message is added to support information and displayed or no message is displayed for an operator having a high skill and showing a short distance between the acceleration evaluation value Ea and the deceleration evaluation value Ed, and the target data. The additional information determination part 68 may determine the additional information on the basis of the distance L in place of the distance "e". In this case, the additional information determination part 68 may determine such emphatic additional information from the additional information table 74 in accordance with an increase in the distance L.

Moreover, although the support information is visually notified through the manipulation support image in the embodiment, the notification way is not limited thereto. The support information may be auditorily notified with a voice or sound.

In this case, the hydraulic excavator 1 may further include a speaker (not shown) arranged in the operator compartment. The controller 6 may further include a voice control part. The voice control part may output voice data of the support information to the speaker. According to the modification, the voice control part serves as an example of the "notification part".

Furthermore, although the support information represents a message for indirectly improving the skill for the boom raising and suspending manipulation on the basis of a state (intensity of the engine sound) of the hydraulic excavator 1 to be focused on by the operator in the embodiment, the support information is not limited thereto. For instance, the support information may represent a message specifically instructing a content (e.g., manipulation way of a lever) of the boom raising and suspending manipulation. In this case, the support information represents a message for directly improving the skill for the boom raising and suspending manipulation.

In addition, although the manipulation support image 700 shown in FIG. 7 is displayed in real time (in the work) in the embodiment, the displaying is not limited thereto. For instance, a manipulation support image may represent a report obtained after the work and including: a skill shift (growth rate) achieved owing to the support (manipulation support); or information to be focused on to realize a better manipulation.

Although the manipulation type of the operator includes the "aggressive" type and the "cautious" type in the embodiment, the manipulation type is not limited thereto. The manipulation type may further include an "intermediate" type between the "aggressive" type and the "cautious" type. In this case, the manipulation type determination part 65 may determine the manipulation type as the "aggressive" type when an acceleration evaluation value Ea is larger than a deceleration evaluation value Ed and a difference |Ea−Ed| between the acceleration evaluation value Ea and the deceleration evaluation value Ed is larger than a predetermined value, determine the manipulation type as the "intermediate" type" when the difference |Ea−Ed| is equal to or smaller than the predetermined value, and determine the manipulation type as the "cautious" type when the acceleration evaluation value Ea is equal to or smaller than the deceleration evaluation value Ed and the difference |Ea−Ed| is larger than the predetermined value.

Summary of Embodiment

A construction machine includes: an operation data acquisition part that acquires operation data about a specific manipulation by an operator to a manipulation target included in the construction machine; an acceleration and deceleration data specifying part that specifies acceleration data being operation data in an acceleration period of the manipulation target and deceleration data being operation data in a deceleration period of the manipulation target among the operation data; an evaluation data acquisition part that acquires acceleration evaluation data for evaluating the acceleration data, and deceleration evaluation data for evaluating the deceleration data; an evaluation value calculation part that calculates, on the basis of the acceleration data and the acceleration evaluation data, an acceleration evaluation value indicating a skill of the operator in the acceleration period, and calculates, on the basis of the deceleration data and the deceleration evaluation data, a deceleration evaluation value indicating a skill of the operator in the deceleration period; a manipulation type determination part that determines, on the basis of the acceleration evaluation value and the deceleration evaluation value, a manipulation type of the operator; and a notification part that gives notification of support information associated with the manipulation type determined by the manipulation type determination part.

According to this configuration, the manipulation type of the operator is determined on the basis of the acceleration evaluation value and the deceleration evaluation value, and the support information associated with the manipulation type is notified to the operator. Hence, a specific manipulation by the operator is more appropriately supported in association with the manipulation type of the operator.

In the construction machine, the support information preferably shows a state of the construction machine to be focused on by the operator to improve a skill for the specific manipulation.

According to this configuration, the support information showing the state of the construction machine to be focused on by the operator to improve the skill of the operator is presentable to the operator.

In the construction machine, the notification part preferably generates a manipulation support image including the support information and an image having a two-dimensional graph in which the acceleration evaluation value and the deceleration evaluation value are plotted over a coordinate axis of the acceleration evaluation value and a coordinate axis of the deceleration evaluation value, and the notification part preferably outputs the generated manipulation support image to a display part.

According to this configuration, the manipulation support image including the support information and the image having the two-dimensional graph in which the acceleration evaluation value and the deceleration evaluation value are plotted is displayed, and thus, the operator can easily confirm the manipulation type thereof.

The construction machine preferably further includes a storage part that stores, in a time series, the acceleration evaluation value and the deceleration evaluation value calculated by the evaluation value calculation part at each execution of the specific manipulation. The notification part preferably generates the manipulation support image including an image having the two-dimensional graph in which a plurality of points each indicating the acceleration evaluation value and the deceleration evaluation value stored in the time series, and an indicator showing a time shift of the acceleration evaluation value and the deceleration evaluation value are further plotted.

According to this configuration, the operator can easily grasp the time shift of the acceleration evaluation value and the deceleration evaluation value through the two-dimensional graph.

The construction machine preferably further includes a frequency determination part that determines a frequency of the notification of the support information on the basis of a distance between evaluation data including the acceleration evaluation value and the deceleration evaluation value, and target data set in advance. The notification part preferably gives the notification of the support information at the frequency determined by the frequency determination part.

This configuration enables notification of the support information at the frequency based on the distance between the evaluation data and the target data.

The construction machine preferably further includes an additional information determination part that determines additional information to be added to the support information on the basis of the distance between the evaluation data including the acceleration evaluation value and the deceleration evaluation value, and the target data set in advance. The notification part preferably gives the notification of the support information including the additional information determined by the additional information determination part.

This configuration allows the support information to include the additional information determined on the basis of the distance between the evaluation data and the target data.

In the construction machine, the manipulation type determination part preferably determines the manipulation type of the operator as an aggressive type when the acceleration evaluation value is larger than the deceleration evaluation value.

This configuration achieves determination on the manipulation type of the operator in detail.

In the construction machine, the manipulation type determination part preferably determines the manipulation type of the operator as the aggressive type when the acceleration evaluation value is larger than the deceleration evaluation value by a predetermined value or larger, determines the manipulation type of the operator as a cautious type when the deceleration evaluation value is larger than the acceleration evaluation value by the predetermined value or larger, and determines the manipulation type of the operator as an intermediate type when an absolute value of a difference between the acceleration evaluation value and the deceleration evaluation value is smaller than the predetermined value.

This configuration achieves determination on the manipulation type of the operator in detail.

In the construction machine, the manipulation type determination part preferably determines the manipulation type of the operator as the cautious type when the acceleration evaluation value is equal to or smaller than the deceleration evaluation value.

This configuration achieves determination on the manipulation type of the operator in detail.

In the construction machine, the state of the construction machine preferably includes an engine sound or soil in a bucket.

According to this configuration, the support information is attainable by using the state of the engine sound or the soil in the bucket.

In the construction machine, the frequency determination part preferably determines the frequency of the notification of the support information with reference to a frequency table defining a relation between the distance and the frequency so that the frequency decreases in accordance with the increase in the distance.

This configuration succeeds in facilitated determination on the frequency of outputting the support information.

In the construction machine, the evaluation value calculation part preferably decreases the acceleration evaluation value in accordance with an increase in a difference between the acceleration data and the acceleration evaluation data, and decreases the deceleration evaluation value in accordance with an increase in a difference between the deceleration data and the deceleration evaluation data.

According to this configuration, the acceleration evaluation value is decreased in accordance with the increase in the difference between the acceleration data and the acceleration evaluation data, and the deceleration evaluation value is decreased in accordance with the increase in the difference between the deceleration data and the deceleration evaluation data, and therefore, the acceleration evaluation value and the deceleration evaluation value are appropriately calculatable.

The construction machine preferably further includes a manipulation part that allows the operator to execute manipulation to the manipulation target. The acceleration data preferably includes an acceleration actuation amount indicating an amount of actuation of the manipulation part by the operator in the acceleration period and an acceleration period value indicating a length of the acceleration period of the operator. The acceleration evaluation data preferably includes an acceleration actuation amount of the manipulation part by a skilled operator in an acceleration period and an acceleration period value of the skilled operator. The evaluation value calculation part preferably decreases the acceleration evaluation value in accordance with an increase in a difference between the acceleration actuation amount by the operator and the acceleration actuation amount by the skilled operator, and an increase in a difference between the acceleration period value of the operator and the acceleration period value of the skilled operator.

According to this configuration, the acceleration evaluation value is decreased in accordance with the increase in the difference between the acceleration actuation amount by the operator and the acceleration actuation amount by the skilled operator, and the increase in the difference between the acceleration period value of the operator and the acceleration period value of the skilled operator. Therefore, an appropriate acceleration evaluation value is calculatable in consideration of the acceleration actuation amount and the acceleration period value.

In the construction machine, the deceleration data preferably includes a deceleration actuation amount indicating an amount of actuation of the manipulation part by the operator in the deceleration period, and a suspended position of the manipulation target in the deceleration period. The deceleration evaluation data preferably includes a deceleration actuation amount of the manipulation part by the skilled operator in a deceleration period, and a suspended position of the manipulation target that is attained by the skilled operator. The evaluation value calculation part preferably decreases the deceleration evaluation value in accordance with an increase in a difference between the deceleration actuation amount by the operator and the deceleration actuation amount by the skilled operator, and an increase in a difference between the suspended position attained by the operator and the suspended position attained by the skilled operator.

According to this configuration, the deceleration evaluation value is decreased in accordance with the increase in the difference between the deceleration actuation amount by the operator and the deceleration actuation amount by the skilled operator, and the increase in the difference between the deceleration period value of the operator and the deceleration period value of the skilled operator. Therefore, an appropriate deceleration evaluation value is calculatable in consideration of the deceleration actuation amount and the deceleration period value.

A construction machine according to another aspect of the present invention includes: a storage part that stores acceleration evaluation data and deceleration evaluation data; and a controller configured to: acquire operation data about a specific manipulation: specify acceleration data being operation data in an acceleration period of a manipulation target and deceleration data being operation data in a deceleration period among operation data; acquire the acceleration evaluation data and the deceleration evaluation data from the storage part; calculate, on the basis of the acceleration data and the acceleration evaluation data, an acceleration evaluation value indicating a skill of the operator in the acceleration period, and calculate, on the basis of the deceleration data and the deceleration evaluation data, a deceleration evaluation value indicating a skill of the operator in the deceleration period; determine, on the basis of the acceleration evaluation value and the deceleration evaluation value, a manipulation type of the operator; and give notification of support information associated with the manipulation type.

According to this configuration, the manipulation type of the operator is determined on the basis of the acceleration evaluation value and the deceleration evaluation value, and the support information associated with the manipulation type is notified to the operator. Hence, a specific manipulation by the operator is more appropriately supported in association with the manipulation type of the operator.

INDUSTRIAL APPLICABILITY

Conclusively, a construction machine according to the present invention is suitable for supporting a specific manipulation by an operator.

The invention claimed is:

1. A construction machine, comprising:

circuitry configured to:

acquire operation data about a specific manipulation by an operator to a manipulation target included in the construction machine;

specify acceleration data being operation data in an acceleration period of the manipulation target and deceleration data being operation data in a deceleration period of the manipulation target among the operation data;

acquire acceleration evaluation data for evaluating the acceleration data, and deceleration evaluation data for evaluating the deceleration data;

calculate, on the basis of the acceleration data and the acceleration evaluation data, an acceleration evaluation value indicating a skill of the operator in the acceleration period, and calculates, on the basis of the deceleration data and the deceleration evaluation data, a deceleration evaluation value indicating a skill of the operator in the deceleration period;

determine, on the basis of the acceleration evaluation value and the deceleration evaluation value, a manipulation type of the operator as either an aggressive type or a cautious type, the aggressive type indicating an acceleration tendency in the manipulation and the cautious type indicating a deceleration tendency in the specific manipulation; and notify of support information associated with the manipulation type, wherein in the notifying, when the specific manipulation indicates the cautious type, the circuitry notifies the support information including a message encouraging an aggressive manipulation, and when the specific manipulation indicates the aggressive type, the circuitry notifies the support information including a message encouraging a cautious manipulation.

2. The construction machine according to claim 1, wherein the support information shows a state of the construction machine to be focused on by the operator to improve a skill for the specific manipulation.

3. The construction machine according to claim 2, wherein the state of the construction machine includes an intensity of an engine sound or soil in a bucket.

4. The construction machine according to claim 1, wherein the circuitry further determines a frequency of the notification of the support information on the basis of a distance between evaluation data including the acceleration evaluation value and the deceleration evaluation value, and target data including an acceleration target value set in advance and a deceleration target value set in advance, wherein the circuitry gives the notification of the support information at the frequency determined by the circuitry.

5. The construction machine according to claim 4, wherein the circuitry decreases the frequency of the notification of the support information in accordance with an increase in the distance.

6. The construction machine according to claim 5, wherein the circuitry determines the frequency of the notification of the support information with reference to a frequency table defining a relation between the distance and the frequency so that the frequency decreases in accordance with the increase in the distance.

7. The construction machine according to claim 1, wherein the circuitry further determines additional information to be added to the support information on the basis of a distance between the evaluation data including the acceleration evaluation value and the deceleration evaluation value, and target data including an acceleration target value set in advance and a deceleration target value set in advance, wherein the circuitry gives the notification of the support information including the additional information determined by the circuitry.

8. The construction machine according to claim 1, wherein the circuitry determines the manipulation type of the operator as the aggressive type when the acceleration evaluation value is larger than the deceleration evaluation value, and determines the manipulation type of the operator as the cautious type when the acceleration evaluation value is equal to or smaller than the deceleration evaluation value.

9. The construction machine according to claim 1, wherein the circuitry determines the manipulation type of the operator as the aggressive type when the acceleration evaluation value is larger than the deceleration evaluation value by a predetermined value or larger, determines the manipulation type of the operator as the cautious type when the deceleration evaluation value is larger than the acceleration evaluation value by the predetermined value or larger, and determines the manipulation type of the operator as an intermediate type when an absolute value of a difference between the acceleration evaluation value and the deceleration evaluation value is smaller than the predetermined value.

10. The construction machine according to claim 1, wherein the circuitry decreases the acceleration evaluation value in accordance with an increase in a difference between the acceleration data and the acceleration evaluation data, and decreases the deceleration acceleration evaluation value in accordance with an increase in a difference between the deceleration data and the deceleration evaluation data.

11. The construction machine according to claim 10, wherein the circuitry further allows the operator to execute manipulation to the manipulation target, wherein the acceleration data includes an acceleration actuation amount indicating an amount of actuation of the manipulation part by the operator in the acceleration period and an acceleration period value indicating a length of the acceleration period of the operator, the acceleration evaluation data includes an acceleration actuation amount of the manipulation part by a skilled operator in an acceleration period and an acceleration period value of the skilled operator, and the circuitry decreases the acceleration evaluation value in accordance with an increase in a difference between the acceleration actuation amount by the operator and the acceleration actuation amount by the skilled operator, and an increase in a difference between the acceleration period value of the operator and the acceleration period value of the skilled operator.

12. The construction machine according to claim 11, wherein the deceleration data includes a deceleration actuation amount indicating an amount of actuation of the manipulation part by the operator in the deceleration period, and a suspended position of the manipulation target in the deceleration period, the deceleration evaluation data includes a deceleration actuation amount of the manipulation part by the skilled operator in a deceleration period, and a suspended position of the manipulation target that is attained by the skilled operator and, the evaluation value calculation part decreases the deceleration evaluation value in accordance with an increase in a difference between the deceleration actuation amount by the operator and the deceleration actuation amount by the skilled operator, and an increase in a difference between the suspended position attained by the operator and the suspended position attained by the skilled operator.

13. A construction machine comprising:

circuitry configured to:

acquire operation data about a specific manipulation by an operator to a manipulation target included in the construction machine;

specify acceleration data being operation data in an acceleration period of the manipulation target and deceleration data being operation data in a deceleration period of the manipulation target among the operation data;

acquire acceleration evaluation data for evaluating the acceleration data, and deceleration evaluation data for evaluating the deceleration data;

calculate, on the basis of the acceleration data and the acceleration evaluation data, an acceleration evaluation value indicating a skill of the operator in the acceleration period, and calculates, on the basis of the deceleration data and the deceleration evaluation data, a deceleration evaluation value indicating a skill of the operator in the deceleration period;

determine, on the basis of the acceleration evaluation value and the deceleration evaluation value, a manipulation type of the operator as either an aggressive type or a cautious type, the aggressive type indicating an acceleration tendency in the manipulation and the cautious type indicating a deceleration tendency in the specific manipulation; and notify of support information associated with the manipulation type, wherein the circuitry generates a manipulation support image including the support information and an image having a two-dimensional graph in which the acceleration evaluation value and the deceleration evaluation value are plotted over a coordinate axis of the acceleration evaluation value and a coordinate axis of the deceleration evaluation value, and the circuitry outputs the generated manipulation support image to a display part.

14. The construction machine according to claim 13, wherein the circuitry further stores, in a time series, the acceleration evaluation value and the deceleration evaluation value calculated at each execution of the specific manipulation, wherein the circuitry generates the manipulation support image including an image having the two-dimensional graph in which a plurality of points each indicating the acceleration evaluation value and the deceleration evaluation value stored in the time series, and an indicator showing a time shift of the acceleration evaluation value and the deceleration evaluation value are further plotted.

15. A construction machine, comprising:

a storage part that stores acceleration evaluation data and deceleration evaluation data; and a controller configured to:

acquire operation data about a specific manipulation by an operator to a manipulation target included in the construction machine;

specify acceleration data being operation data in an acceleration period of the manipulation target and deceleration data being operation data in a deceleration period of the manipulation target among the operation data;

acquire the acceleration evaluation data and the deceleration evaluation data from the storage part;

calculate, on the basis of the acceleration data and the acceleration evaluation data, an acceleration evaluation value indicating a skill of the operator in the acceleration period, and calculate, on the basis of the deceleration data and the deceleration evaluation data, a deceleration evaluation value indicating a skill of the operator in the deceleration period;

determine, on the basis of the acceleration evaluation value and the deceleration evaluation value, a manipulation type of the operator as either an aggressive type or a cautious type, the aggressive type indicating an acceleration tendency in the specific manipulation and the cautious type indicating a deceleration tendency in the specific manipulation; and give notification of support information associated with the manipulation type, wherein in the giving notification, when the specific manipulation indicates the cautious type, the controller notifies the support information including a message encouraging an aggressive manipulation, and when the specific manipulation indicates the aggressive type, the controller notifies the support information including a message encouraging a cautious manipulation.

* * * * *